United States Patent [19]

Theurer

[11] Patent Number: 4,537,135

[45] Date of Patent: Aug. 27, 1985

[54] TAMPING UNIT

[75] Inventor: Josef Theurer, Vienna, Austria

[73] Assignee: Franz Plasser Bahnbaumaschinen Industriegesellschaft m.b.H., Vienna, Austria

[21] Appl. No.: 575,059

[22] Filed: Jan. 30, 1984

[30] Foreign Application Priority Data

May 4, 1983 [AT] Austria ..... 1648/83

[51] Int. Cl.[3] ..... E01B 27/16

[52] U.S. Cl. ..... 104/12

[58] Field of Search ..... 104/7 R, 7 B, 10, 12

[56] References Cited

U.S. PATENT DOCUMENTS

| | | | |
|---|---|---|---|
| 3,534,687 | 10/1970 | Plasser et al. | 104/12 |
| 3,653,327 | 4/1972 | Sauterel | 104/12 |
| 4,258,627 | 3/1981 | Theurer | 104/12 |
| 4,428,297 | 1/1984 | Ganz | 104/12 |
| 4,445,437 | 5/1984 | Nielsen | 104/12 |
| 4,458,600 | 7/1984 | Hurni | 104/12 |

FOREIGN PATENT DOCUMENTS

| | | |
|---|---|---|
| 704994 | 3/1965 | Canada . |
| 2094868 | 9/1982 | United Kingdom . |
| 2094869 | 9/1982 | United Kingdom . |

*Primary Examiner*—Randolph A. Reese

*Attorney, Agent, or Firm*—Kurt Kelman

[57] ABSTRACT

A ballast tamping unit has a vibratory and reciprocable tamping tool holder pivotal in the direction of the track about a fulcrum intermediate the tamping tool holder ends. Two side-by-side tamping picks are mounted on the lower tamping tool holder end for immersion in the ballast upon vertical adjustment of the tamping tool carrier, a first one of the tamping picks being closer to the rail than the other tamping pick and the two tamping picks being mounted at least on one side of the rail for independent pivoting in a plane extending perpendicularly to the direction of reciprocation between an operating position wherein the picks extend substantially vertically for immersion in the ballast and an inoperative position wherein the picks extend substantially horizontally above the track, and separate power drives pivot the two tamping picks independently of each other.

9 Claims, 5 Drawing Figures

TAMPING UNIT

The present invention relates to a tamping unit for a track working machine mounted for mobility on a track comprised of two rails fastened to a succession of ties resting on ballast, which comprises a vertically adjustable tamping tool means carrier, and a vibratory tamping tool means mounted on the carrier for reciprocation in a direction towards and away from a respective one of the ties. The tamping tool means includes a tamping tool holder constituted by a pivotal lever, the tamping tool holder having an upper end and a lower end, and the holder being pivotal in said direction about a fulcrum extending perpendicularly to said direction intermediate the tamping tool holder ends, and a power drive connected to the tamping tool holder pivots the holder in said direction.

Canadian Pat. No. 704,994, dated Mar. 2, 1965, discloses such a tamping unit with a single tamping pick mounted on the lower tamping tool end for immersion in the ballast upon vertical adjustment of the tamping tool carrier. The pick may be pivoted in a plane extending perpendicularly to the direction of reciprocation through a small angle to move it laterally out of the way of structural track parts which may hinder the immersion of the tamping jaw in the ballast, such as guardrails, switches and frogs. Such tamping units have been widely used with considerable success since they may be operated in track sections which permit immersion of a tamping pick at only one side of the associated rail while the other pick is laterally pivoted into an inoperative position so as not to interfere with the immersion of the pick at the other side of the rail.

This principle is incorporated in the tamping unit of U.S. Pat. No. 4,258,627, dated Mar. 31, 1981, which comprises a common, bifurcated tamping tool holder for a plurality of tamping tools for immersion in a respective crib on each side of the rail in respective groups mounted on two laterally extending holder arms straddling the rail, each group comprising at least one tamping tool. In one embodiment, a single, laterally pivotal tamping tool forms each group. In another embodiment, the group at the field side of the rail consists of two side-by-side tamping tools rigidly mounted on one of the holder arms while the group at the gage side of the rail consists of a single, laterally pivotal tamping tool. A further embodiment provides groups of two side-by-side tamping tools at each rail side, the group at the gage side being laterally pivotal in unison. This tamping unit may be used along tangent track on a production tamper as well as on switch tampers for tamping relatively long switches wherein structural parts obstructing the immersion of tamping tools occur solely at the gage side.

In the switch tamper of U.S. Pat. No. 3,534,687, dated Oct. 20, 1970, the tamping unit is designed for the simultaneous tamping of two adjacent ties. Two vibratory tamping tool groups are supported on a common vertically adjustable carrier adjacent each other in the direction of track elongation, the spacing thereof being such that adjacent tools of the adjacent groups may be immersed in the ballast in the crib between the two ties. A single laterally pivotal tamping tool is arranged at each side of the rail, similar to the arrangement of the Canadian patent.

U.S. Pat. No. 3,653,327, dated Apr. 4, 1972, a mobile track tamper with two separate vertically adjustable tamping tool units suspended at their upper ends from the roof of the tamper frame, each unit comprising a pair of reciprocable vibratory tamping tools for immersion in the ballast. Each unit may be laterally pivoted in a plane extending perpendicularly to the direction of reciprocation of the tools so that the tools of the unit may be so displaced as to avoid obstacles along a respective side of the rail. In other words, either both tamping tools of a respective unit are in an operative position for tamping along a respective rail side or both tools are pivoted into an inoperative position. Thus, relatively long portions of a track switch will have to be tamped along one side of the rail only while the other side is not tamped at all when the tamping tool unit is swung into its inoperative position. Furthermore, the pendulum suspension of the tamping units fails to provide the rigid relationship to the machine frame important for the transmission of the tamping forces.

UK Pat. applications Nos. 2,094,868 A and 2,094,869 A, both published Sept. 22, 1982, deal with the same type of suspended tamping units comprising a tamping pick attached by a mechanism permitting its replacement by a pair of side-by-side picks or the addition of another pick to form such a pair so that the tamper may be used selectively for working in tangent track and switches. In one embodiment, a tubular guide bushing extends laterally from the tamping tool holder and an auxiliary tamping pick is vertically displaceable in the bushing and may be locked in an upper and lower end position. In the lower end position, the auxiliary pick is side-by-side, and level with, the main tamping pick arranged rigidly on the holder. Such a structure is complex and difficult to operate. In another embodiment, a pistolhead-shaped tamping tool mount having an axis enclosing an acute angle with the track plane and extending transversely to the track is disposed on the tamping tool holder and has a single tamping pick affixed thereto while a pair of side-by-side picks are secured diametrically opposite thereto. When the mount is pivoted, the ends of the tamping picks move along a circular path of a larger radius, requiring considerable free space at both sides of the tamping unit. This, however, is hardly ever available, particularly if such tamping tool means are arranged at both sides of the rail. Furthermore, suitable abutments must be provided to block the tamping picks in their respective operative positions and it is not possible to retrofit existing tamping units with these mechanisms for replacing picks without very substantial structural changes.

It is the primary object of this invention to provide a tamping unit of the first-described type with two side-by-side tamping picks which are so arranged that their operative positions may be particularly well adapted to the prevailing condition and configuration of the track structure and they may be selectively used for effective tamping in different operating situations. It is a further object of the invention to arrange these tamping picks so that they may readily fit into the basic structural concept of tamping units of this type.

According to the present invention, such a tamping unit meets the above and other objects in a surprisingly simple manner with two side-by-side tamping picks mounted on the lower tamping tool holder end adjacent at least one side of a respective one of the rails for immersion in the ballast upon vertical adjustment of the tamping tool means carrier. A first one of the tamping picks is closer to the one rail than the other tamping pick and the two tamping picks are mounted for independent pivoting in a plane extending perpendicularly to the direction of reciprocation between an operating position wherein the picks extend substantially vertically for immersion in the ballast and an inoperative position wherein the picks extend substantially horizontally above the track. Separate power drives pivot the two tamping picks independently of each other.

This arrangement provides high-quality tamping under all track conditions in tangent track and switches, is very efficient and provides a robust structure while enabling each tamping pick to be adjusted individually into a position best designed to serve the locally required purpose, each pick being pivotal through an angle of about 90° so that any required operative or inoperative position may be assumed by each pick. Thus, the tamping unit may be operated with both picks immersed in the ballast at one or both sides of the rail, with only one tamping pick immersed in the ballast while the other pick has been pivoted into its inoperative position, or with both picks swung upwardly high enough to avoid any obstacles along the right-of-way. If the separate power drives for pivoting the two tamping picks between their operative and inoperative positions are of the same structure and dimensions, the control of the pivoting movements will be the same for both picks whereby the operation and proper positioning of the tamping tools will be simplified and facilitated.

The above and other objects, advantages and features of this invention will become more apparent from the following detailed description of certain now preferred embodiments thereof, taken in conjunction with the accompanying, partially schematic drawing wherein FIG. 1 is a side elevational view of an embodiment of the tamping unit for a mobile track working machine according to the invention;

Figure 1:
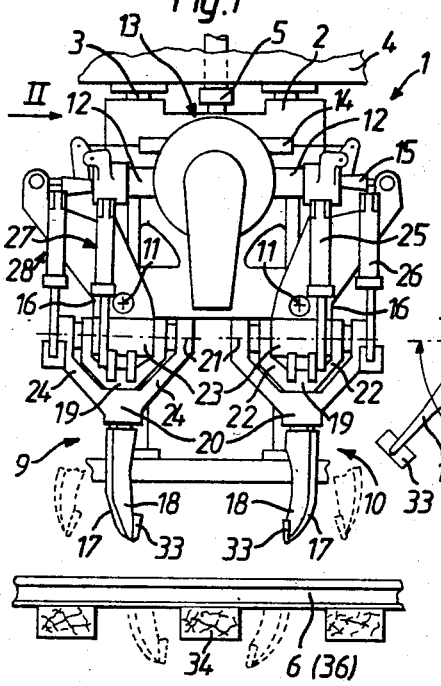
Figure 2:
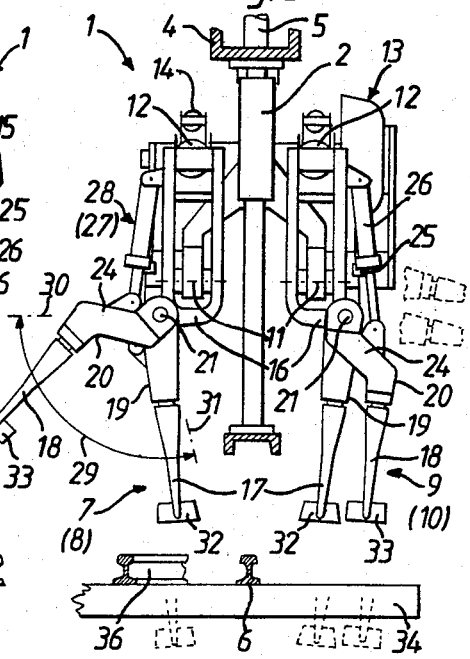
FIG. 2 is an end view of the tamping unit seen in the direction of arrow II.
Figure 3:
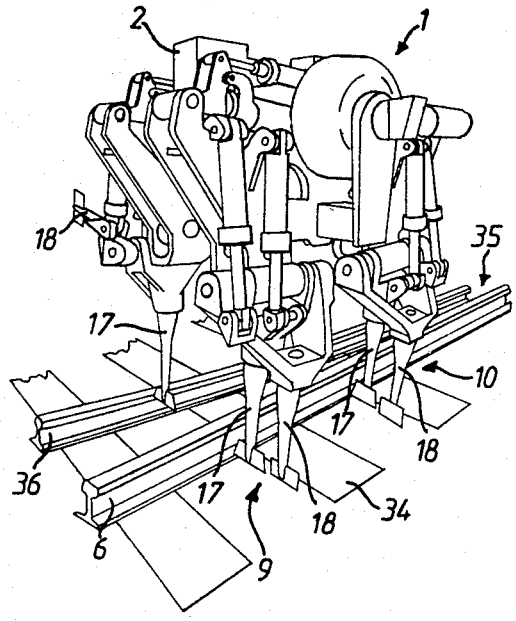
FIG. 3 is a perspective view of the tamping unit.

Referring now to the drawing and first to FIGS. 1 to 3, there is shown tamping unit 1 for a track working machine mounted for mobility on a track comprised of two rails 6 fastened to a succession of ties 34 resting on ballast, only frame 4 of the machine being illustrated. The track working machine may be a track leveling, lining and tamping machine for tamping tangent track, switches and crossings. The tamping unit comprises tamping tool means carrier 2 vertically adjustably mounted on two vertical guide posts 3 of machine frame 4. Carrier 2 is moved along the guide posts by power drive 5. In the illustrated embodiments, this and all other power drives are hydraulically operated cylinder-piston drives. A respective tamping tool means carrier 2 is centered above each track rail 6. Vibratory tamping tool means 7, 8 and 9, 10 are mounted on carrier 2 for reciprocation in a direction towards and away from a respective tie 34. The tamping tool means is arranged to straddle the tie for reciprocation towards and away from each other and the tie, and includes a tamping tool holder 16 arranged on each side of the rail with which the tamping tool means is associated. Each tamping tool holder has an upper end and a lower end, the the holder is pivotal in the direction of reciprocation about fulcrum 11 extending perpendicularly to this direction and transversely to the direction of elongation of the track intermediate the tamping tool holder ends. One end of power drive 12 is connected to the upper end of each tamping tool holder 16 for pivoting the holder in the direction of reciprocation, while an opposite end of the power drives is linked to centrally disposed vibratory drive 13 constituted by a crank shaft arrangement. Adjustable stop 15 operated by power drive 14 is coordinated with each power drive 12 in a conventional manner to limit the reciprocating path so as to set an outer limit for the opening movement of the pincer-like tamping tools. Tamping units of this general type are known and their structure and operation need, therefore, not be described in further detail.

According to the present invention, two side-by-side tamping picks 17, 18 are mounted on the lower tamping tool holder end adjacent at least one side of respective rail 6 for immersion in the ballast upon vertical adjustment of tamping tool means carrier 2. Tamping pick 17 is closer to rail 6 than tamping pick 18 and the two tamping picks are mounted for independent pivoting in a plane extending perpendicularly to the direction of reciprocation between operating position 31 wherein the picks extend substantially vertically for immersion in the ballast and inoperative position 30 wherein the picks extend substantially horizontally above the track. Separate power drives 25, 26 and 27, 28 pivot the two tamping picks on respective holder 16 independently of each other. Preferably, a common pivot 21 for the two side-by-side tamping picks is arranged on the lower tamping tool holder end and extends in the direction of reciprocation. This arrangement is particularly simple and compact, requiring a minimum of space for the positioning of the two picks.

As shown in the drawing, bifurcated mounting yoke 19, 20 is provided for each tamping pick 17, 18. Each yoke has two arms 22 and 24. Tamping tool holder 16 includes bearing body 23 for yokes 19 and 20, the bearing body incorporating common pivot 21 for the two side-by-side tamping picks 17 and 18. The yoke arms are mounted on respective ends of common pivot 21, arms 22 of yoke 19 carrying closer tamping pick 17 being positioned immediately adjacent bearing body 23 while arms 24 of yoke 20 carrying other tamping pick 18 laterally overlap arms 22. This interleaved double bearing of each of the two side-by-side picks on a common pivot provides a solid and stiff connection of the tamping picks with their holder and their reciprocating and vibratory drives so that a substantially complete transmission of even considerable operating forces is assured. This structure also is very robust and subject to relatively little wear.

Each separate pivoting drive 25, 26 and 27, 28 for the side-by-side tamping picks is a double-acting hydraulic cylinder-piston unit having respective ends linked to tamping tool holder 16 and respective bifurcated mounting yoke 19, 20. The pivoting drives are arranged adjacent each other in the direction of reciprocation and at a side of the holder facing away from rail 6. As best shown in FIG. 2, this arrangement of the pivoting drives enables the available space to be used to optimal advantage without significantly interfering with the view of the machine operator in the direction of the tamping site.

Cylinder-piston drive unit 26, 28 disposed farther from the center of tamping unit 1 in the direction of reciprocation is linked to an outer one of arms 24 of bifurcated mounting yoke 20 carrying tamping pick 18, and the other cylinder-piston drive unit 25, 27 is linked to the other bifurcated mounting yoke 19 between arms 24 of yoke 20, yoke 19 carrying tamping pick 17. Preferably, as illustrated, the pistons of the drive units are linked to the mounting yokes. This interdigitating drive connection between the mounting yokes and the drive units assures full freedom of pivoting movement for both tamping picks over a large pivoting angle.

As shown by two-headed arrow 29 in FIG. 2, the pivoting range of tamping picks 17, 18 extends over an angle exceeding 90° so that each pick may independently assume any position between operative position 31 and inoperative position 30. In this manner, track work may proceed even in very difficult track sections by suitably positioning the respective tamping picks, only one of the two side-by-side picks being used, for example, for tamping a frog at the field side of rail 6 while both side-by-side picks remain in operative position for tamping the ballast under tie 34 at the gage side of the rail (see FIG. 2). If an obstacle should be encountered along a track section at the field side of the rail, both side-by-side picks at that side may be pivoted upwardly into inoperative position 30 to permit continuance of the tamping operation at the gage side. In this manner, utmost adaptability of the tamping unit to different working conditions is assured.

As shown in FIG. 2, arms 24 of bifurcated mounting yoke 20 have an upper portion adjacent tamping tool holder 16 offset towards rail 6 with respect to the lower portion thereof, the two arm portions enclosing an angle with each other. This offset arrangement of the mounting yoke makes it possible to use mass-produced tamping picks with substantially rectilinearly extending shafts while maintaining the desired lateral distance between the side-by-side tamping picks.

Tamping jaws 32, 33 are mounted at the lower ends of tamping picks 17, 18, their dimensions being such that the tamping jaws do not overlap when both side-by-side tamping picks are in the operative position. This facilitates the penetration of the jaws and picks into the ballast when tamping tool means carrier 2 is lowered since a miminum of surface resistance will be offered by the jaws as they enter the ballast, which would not be the case if the adjacent tamping jaws overlapped and thus offered an enlarged surface area to the ballast. As shown, tamping jaw 32 of closer tamping pick 17 is trapezoidally shaped and will partially subtend the adjacent rail when immersed in the ballast. Tamping jaw 33 of other tamping pick 18 is substantially rectangular. This configuration of the tamping jaws takes into account the fact that tamping obstacles or track points which are difficult to tamp are usually found in the operating range of closer tamping pick 17. The trapezoidal shape of the tamping jaw then permits immersion of the jaw in the ballast even in very narrow spots if the pick is pivoted into end position 31 which is slightly inclined from the vertical towards adjacent rail 6 so that the tamping jaw subtends the rail partially. A rectangular tamping jaw has a substantially larger diagonal dimension, which would make its operation in such a tight spot impossible. The trapezoidal shape of the tamping jaw is also advantageous for the tamping of frogs so that the frog may be subtended somewhat by the tamping jaw when the tamping picks are reciprocated during the tamping operation.

FIGS. 2 and 3 illustrate tamping unit 1 in the raised position straddling a point of intersection between rail 6 and tie 34 in partially shown switch 35. Rail 6 forms the outer through rail of the straight main track at the switch while rail 36 constitutes the neighboring, arcuate guardrail, i.e. the rail of the branch track between the switch and the frog. Since there are no obstacles to tamping at the field side of rail 6 in the range of the tie ends, tamping picks 17, 18 of tamping tool means 9, 10 at the field side of the rail may be immersed together into the cribs adjacent tie 34, with their tamping jaws adjoining, and parallel to, each other. However, at the gage side of the rail, the tamping picks of tamping tool means 7, 8 cannot both be immersed into the small space between guardrail 36 and rail 6. Therefore, tamping pick 18 is pivoted upwards into an inoperative position to permit immersion of the tamping jaw of pick 17 into the ballast and thus to permit tamping even in this tight spot.

FIGS. 1 and 2 show the reciprocating positions of the tamping picks and their immersed position in broken lines. Furthermore, FIG. 1 indicates in broken line the maximal opening position of the reciprocating picks obtained by pivoting stops 15 upwardly by drives 14 out of the path of reciprocating drives 12 so as to permit the tamping tools to be used for tamping double ties. FIG. 2 also indicates in broken lines an inoperative position of both tamping picks at the field side of rail 6. This position will be required, for example, when an obstacle is encountered in the range of the tie ends, such as a switch operating mechanism or the like, which would make it impossible for the tamping tools to be immersed into the ballast at that point or even to pass this point in the lowered position of the tamping picks.

Figure 4:
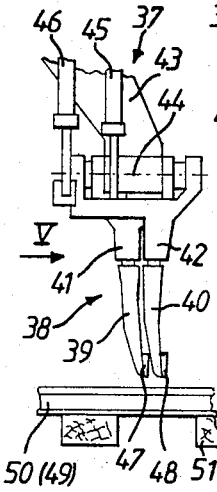
FIG. 4 is a fragmentary side elevational view of another embodiment of the tamping unit of this invention.
Figure 5:
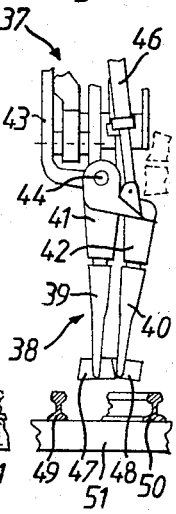
FIG. 5. is an end view of this tamping unit seen in the direction of arrow V.

FIGS. 4 and 5 illustrate another embodiment. The drawing shows only tamping tool means 38 of tamping unit 37 at the field side of rail 49. Bifurcated yokes 41, 42 mount side-by-side tamping picks 39, 40 on tamping tool means holder 43 for reciprocation about common pivot 44. Contrary to the embodiment of FIGS. 1 to 3, the lower ends of mounting yokes 41, 42 and, therefore, tamping picks 39, 40 affixed thereto are slightly staggered from each other in the direction of reciprocation, i.e. the elongation of the track. This, as shown in FIG. 5, enables tamping jaws 47, 48 of the side-by-side tamping picks to be at least partially overlapped when they are pivoted into selected positions by their separate drives 45, 46. This arrangement makes it possible to tamp with both picks even in a very tight spot between two neighboring rails 49, 50, for instance the inner rails of a switch approaching each other at an acute angle. While this makes penetration into the ballast more difficult, it provides an increased effective width of tamping. As shown in FIG. 4, yoke 42 of outer tamping pick 40 has an asymmetric bifurcation with a portion offset towards the center of the tamping unit to which the pick is affixed, and this makes it possible to pivot the two picks so closely together that their tamping jaws overlap.

While the present invention has been described and illustrated in connection with certain now preferred embodiments thereof, it will be obvious to those skilled in the art that many modifications and variations may be made therein without departing from the spirit and scope of this invention, as defined in the appended claims, particularly with respect to the structure of the tamping picks and their mounting. Thus, one or both of the two side-by-side tamping picks and/or their mounting arms may have offset portions so as to enable the tamping jaws to be staggered from each other in the direction of reciprocation. Furthermore, the two picks may be pivoted about separate, parallel fulcrums as long as separate pivoting drives are used.

What is claimed is:

1. A tamping unit for a track working machine mounted for mobility on a track comprised of two rails fastened to a succession of ties resting on ballast, which comprises (a) a vertically adjustable tamping tool means carrier, (b) a pair of vibratory tamping tool means arranged to straddle a respective one of the ties and mounted on the carrier for reciprocation in a direction towards and away from the one tie, each of the tamping tool means on each rail side including (1) a tamping tool means holder constituted by a pivotal lever, the tamping tool means holder having an upper end and a lower end, and the holder being pivotal in said direction about a fulcrum extending perpendicularly to said direction intermediate the tamping tool holder ends, (2) a power drive connected to the tamping tool means holder for pivoting the holder in said direction, (3) two side-by-side tamping picks mounted on the lower tamping tool means holder end adjacent each side of a respective one of the rails for immersion in the ballast upon vertical adjustment of the tamping tool means carrier, a first one of the tamping picks on each side of the one rail being closer to the one rail than the other tamping pick and the two tamping picks on each side being mounted for independent pivoting in a plane extending perpendicularly to the direction of reciprocation between an operating position wherein the picks extend substantially vertically for immersion in the ballast and an inoperative position wherein the picks extend substantially horizontally above the track, and (4) separate power drives for pivoting the two tamping picks on each side independently of each other.

2. The tamping unit of claim 1, further comprising a common pivot for the two tamping picks arranged on the lower tamping tool means holder end and extending in the direction of reciprocation.

3. The tamping unit of claim 2, further comprising a bifurcated mounting yoke for each one of the tamping picks, each one of the yokes having two arms, and the tamping tool means holder including a bearing body for the yokes, the bearing body incorporating the common pivot, the arms of one of the yokes laterally overlapping the arms of the other yoke and the yoke arms being mounted on respective ends of the pivot.

4. The tamping unit of claim 3, wherein each one of the separate pivoting drives is a hydraulic cylinder-piston unit having respective ends linked to the tamping tool means holder and a respective one of the bifurcated mounting yokes, said pivoting drives being arranged adjacent each other in the direction of reciprocation and at a side of the holder facing away from the one rail.

5. The tamping unit of claim 4, wherein the cylinder-piston drive unit disposed farther from the center of the tamping unit in the direction of reciprocation is linked to an outer one of the arms of the one bifurcated mounting yoke in the direction of reciprocation, the one yoke carrying the other tamping pick, and the other cylinder-piston drive unit is linked to the other bifurcated mounting yoke between the arms of the one yoke, the other yoke carrying the closer tamping pick.

6. The tamping unit of claim 5, wherein the pistons of the drive units are linked to the mounting yokes.

7. The tamping unit of claim 3, wherein the arms of the one bifurcated mounting yoke have an upper portion adjacent the tamping tool means holder offset towards the one rail with respect to a lower portion thereof, the two arm portions enclosing an angle with each other.

8. The tamping unit of claim 1, further comprising tamping jaws mounted at the lower ends of the tamping picks, the dimensions of the tamping jaws being such that the tamping jaws do not overlap when both tamping picks are in the operative position.

9. The tamping unit of claim 8, wherein at least the tamping jaw of the closer tamping pick is trapezoidally shaped.

* * * * *